US009931628B2

(12) United States Patent
LaCroix

(10) Patent No.: US 9,931,628 B2
(45) Date of Patent: Apr. 3, 2018

(54) VOLUME ADJUSTMENT FOR MANUAL PIPETTOR

(71) Applicant: Integra Biosciences AG, Zizers (CH)

(72) Inventor: Christopher P. LaCroix, Bedford, NH (US)

(73) Assignee: Integra Biosciences AG (CH)

( * ) Notice: Subject to any disclaimer, the term of this patent is extended or adjusted under 35 U.S.C. 154(b) by 18 days.

(21) Appl. No.: 15/075,377

(22) Filed: Mar. 21, 2016

(65) Prior Publication Data

US 2016/0303557 A1 Oct. 20, 2016

Related U.S. Application Data

(60) Provisional application No. 62/148,270, filed on Apr. 16, 2015.

(51) Int. Cl.
*B01L 3/02* (2006.01)

(52) U.S. Cl.
CPC ..... *B01L 3/0224* (2013.01); *B01L 2200/0605* (2013.01); *B01L 2200/087* (2013.01); *B01L 2300/026* (2013.01); *B01L 2400/0478* (2013.01)

(58) Field of Classification Search
None
See application file for complete search history.

(56) References Cited

U.S. PATENT DOCUMENTS 4,616,514 A * 10/1986 Magnussen, Jr. ..... B01L 3/0227 403/369
4,744,955 A 5/1988 Shapiro
4,909,991 A 3/1990 Oshikubo
5,021,217 A * 6/1991 Oshikubo ..... B01L 3/0217 422/516
5,104,624 A 4/1992 Labriola
5,187,990 A 2/1993 Magnussen, Jr.
5,320,810 A * 6/1994 Al-Mahareeq ..... B01L 3/0224 422/517
5,531,131 A 7/1996 Sabloewski
5,650,124 A 7/1997 Gilson
5,792,424 A 8/1998 Homberg et al.
5,849,248 A 12/1998 Homberg
5,983,733 A 11/1999 Strandberg et al.
6,352,673 B1 3/2002 Rainin et al.
(Continued)

FOREIGN PATENT DOCUMENTS

FR 2493515 5/1982

OTHER PUBLICATIONS

International Search Report and Written Opinion, PCT application PCT/IB2016/051589, dated Jun. 20, 2016.
(Continued)

*Primary Examiner* — Jill Warden
*Assistant Examiner* — Brittany Fisher
(74) *Attorney, Agent, or Firm* — Andrus Intellectual Property Law, LLP

(57) ABSTRACT

A manual pipette includes a manual volume adjustment having three discreet resolutions. The pipette uses three rotatable step cylinders and one non-rotatable cylinder to set the overall stroke length for the piston. The step cylinders are rotated by manual dials that are accessible on either side of the pipette body. The dial bodies include numerical scales corresponding to the setting of the respective step cylinders.

15 Claims, 10 Drawing Sheets

(56) References Cited

U.S. PATENT DOCUMENTS

| | | | | |
|---|---|---|---|---|
| 6,428,750 | B1 | 8/2002 | Rainin et al. | |
| 6,923,938 | B2 | 8/2005 | Cote et al. | |
| 7,175,813 | B2 | 2/2007 | Petrek et al. | |
| 7,204,163 | B2 * | 4/2007 | Uldry | B01L 3/0224 73/864.18 |
| 7,726,212 | B2 | 6/2010 | Magnussen et al. | |
| 7,770,475 | B2 | 8/2010 | Magnussen et al. | |
| 7,788,986 | B2 | 9/2010 | Magnussen et al. | |
| 7,819,030 | B2 | 10/2010 | Magnussen et al. | |
| 8,133,453 | B2 * | 3/2012 | Molitor | B01L 3/0224 422/500 |
| 8,297,134 | B2 | 10/2012 | Wilmer | |
| 8,397,593 | B2 | 3/2013 | Petrek et al. | |
| 8,646,343 | B2 | 2/2014 | Kimura et al. | |
| 8,900,526 | B2 | 12/2014 | Uldry | |
| 2005/0155438 | A1 * | 7/2005 | Belgardt | B01L 3/0217 73/864.01 |
| 2011/0132110 | A1 * | 6/2011 | Kimura | B01L 3/0224 73/864.01 |
| 2014/0147349 | A1 * | 5/2014 | Schmidt | B01L 3/0279 422/522 |
| 2014/0242719 | A1 | 8/2014 | Heinonen | |

OTHER PUBLICATIONS

Socorex Isba S.A., http://socorex.com, Products>digital adjustment pipettes>Calibra digital 822 highlights, website visited Dec. 4, 2014.

Socorex Isba S.A., http://socorex.com, Calibra digital product information, website visited Dec. 4, 2014.

Thermo Scientific Finnpipette Focus brochure, copyright 2007.

* cited by examiner

VOLUME ADJUSTMENT FOR MANUAL PIPETTOR

FIELD OF THE INVENTION

The invention pertains to volume adjustment in manual pipettes having thumb-actuated plungers.

BACKGROUND OF THE INVENTION

Most conventional manual pipettes have a plunger button on the top of the handle. The plunger button is depressed by the user's thumb to manually lower a plunger shaft which in turn lowers a pipetting piston. A disposable pipette tip is mounted on a fitting attached to the lower portion of the pipette. The seal around the pipetting piston causes suction in the disposable pipette tip when the piston is retracted. To aspirate liquid into the disposable pipette tip, the end of the tip is submerged in the liquid and, the user releases the plunger. A piston return spring causes the piston to retract thereby causing suction within the pipette tip to aspirate the liquid into the tip. The user then moves the pipette to a dispensing location and again depresses the plunger against the force of the spring in order to dispense the liquid from the pipette tip. Most manual pipettes also include a blowout spring mechanism that enables the plunger to move downward past the natural fully depressed range for aspiration in order to blow out residual liquid when dispensing from the tip

SUMMARY OF THE INVENTION

The invention is a manual pipettor that provides manual volume adjustment with fine resolution. More specifically, the invention uses three step cylinders to adjust the full piston stroke length. One cylinder has large steps, an intermediate cylinder has steps with intermediate sizes and the third cylinder provides small steps for fine volume adjustment. A non-rotatable cylinder interfaces between the steps of the intermediate cylinder and one of the other step cylinders. Manual dials are used to rotate the step cylinders to adjust the setting of the stroke length. A scale is present on the dial bodies for each respective cylinder. The scale for the fine and intermediate dials is desirably 0 to 9 or 0.0 to 0.9, although other scales can be used. The dials are desirably accessible from both sides of the pipette body so that they can be turned by the user's finger and opposing thumb on one hand. The dials do not move vertically with respect to the body of the pipette. Intermediate couplings are used to couple the inside of the dial body to the respective step cylinder. In one embodiment, a light spring biases the non-rotatable cylinder and the coarse step cylinder away from the intermediate step cylinder, when the piston return spring is unloaded, in order to enhance the operation of the manual pipettor.

DETAILED DESCRIPTION OF THE DRAWINGS

Figure 1:
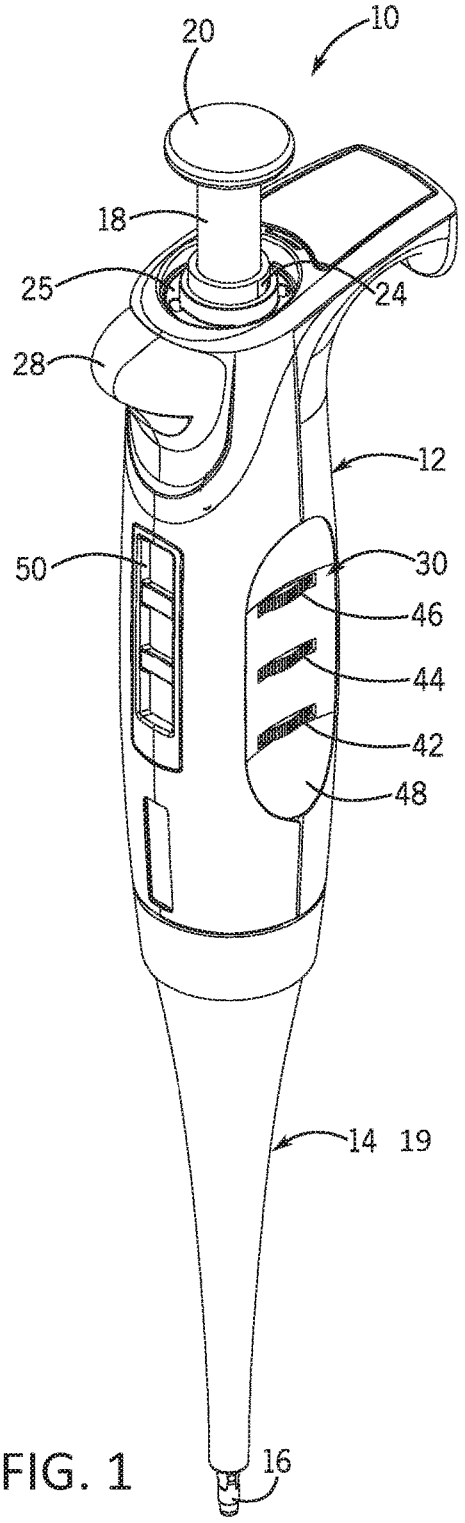
FIG. 1 is a perspective view of a manual pipette constructed in accordance with an exemplary embodiment of the invention.

FIGS. 1 through 13 illustrate a manual pipette 10 that is constructed in accordance with an exemplary embodiment of the invention. Referring in particular to FIG. 1, the manual pipette 10 includes an upper handle portion 12 and a lower portion 14 that is detachable from the upper handle portion 12. The lower portion 14 includes a tip fitting 16 at its distal end. A disposable pipette tip, not shown, is mounted to the tip fitting 16 in order to aspirate liquid into the pipette tip for liquid transfer. Aspects of the invention can be implemented in manual pipettes that do not enable the use of disposable tips, such as syringe-based manual pipettes. In use, the upper handle portion 12 is grasped by the hand of a user. The user depresses plunger button 20 with their thumb to move a plunger shaft 18 and a piston holder 22 (FIGS. 8 through 12) coupled to the plunger shaft 18 downward against spring force, and releases the plunger button 20 to retract the plunger shaft 18 and piston holder 22 and aspirate liquid into a pipette tip mounted onto the fitting 16. Liquid is dispensed from the pipette tip by depressing the plunger button 20. The plunger shaft 18 and piston holder 22 always move in unison. FIG. 6 shows the plunger button 20 removed with threads 23 in the top of the plunger shaft 18 exposed. A tip ejector button 28 is also located on the handle, as well as a volume adjustment mechanism 30.

Referring briefly to FIGS. 8 through 12 to describe overall operation of the pipette 10, the pipette 10 includes a piston holder 22, a piston return spring 26, a spring retaining base 32, and a magnet 34. The magnet 34 is secured to the lower end of the piston holder 22, for example with adhesive. The magnet 34 couples a piston 36 to the piston holder 22. The piston holder 22 is able to slide through the spring retaining base 32. The piston 36 reciprocates in the sealed cylinder 38 (the O-ring and PTFE seal 40, FIG. 11) to aspirate and dispense liquid in a disposable tip mounted on fitting 16.

The plunger shaft 18 includes a plunger positioning boss 43 (FIG. 7) that physically interacts with a volume adjustment mechanism 30, which together cooperate to set the overall aspiration range of motion of the piston holder 22, and piston 36. Boss 43 on the plunger shaft 18 resides in an area within the upper handle portion 12 that provides clearance for volume adjustment. As the user depresses the plunger button 20 downward, the plunger shaft 18 pushes downward and the spring 26 compresses. Once the plunger button 20 is fully depressed to a full aspiration position, the user places the distal end of the disposable pipette tip in the liquid and releases the plunger button 20. As the user releases the plunger button 20, the piston return spring 26 pushes the piston holder 22 upward and pulls the piston 36 upward via the magnet 34. The upward motion of the piston 36 causes suction within the disposable pipette tip mounted on the tip fitting 16 to aspirate liquid into the tip. The spring force is normally selected by the manufacturer to overcome the friction force associated with the O-ring 70/PTFE seal 40 against the piston 36 as well as any other relevant frictional forces.

In order to dispense liquid from a disposable pipette tip mounted on the tip fitting 16, the user presses the plunger button 20 downward to release the suction caused by the retracted piston 36. When the last portion of the sample is dispensed, the user pushes downward on the plunger button 20 beyond its normal stroke, as is known in the art, to blow out residual liquid in the pipette tip, see FIG. 10. As the plunger button 20 is pushed downward into the depression 25 in the top of the upper handle portion 12, the plunger button 20 engages blowout sleeve 24. The blowout sleeve 24 includes a stop that is normally biased upwards by a spring. However, when the user continues to push the plunger button 20 downward against the blowout sleeve 24 and the resistance of the blow out spring, the piston holder 22 and piston 36 are pushed downward beyond the normal stroke to facilitate blowout.

Figure 2:
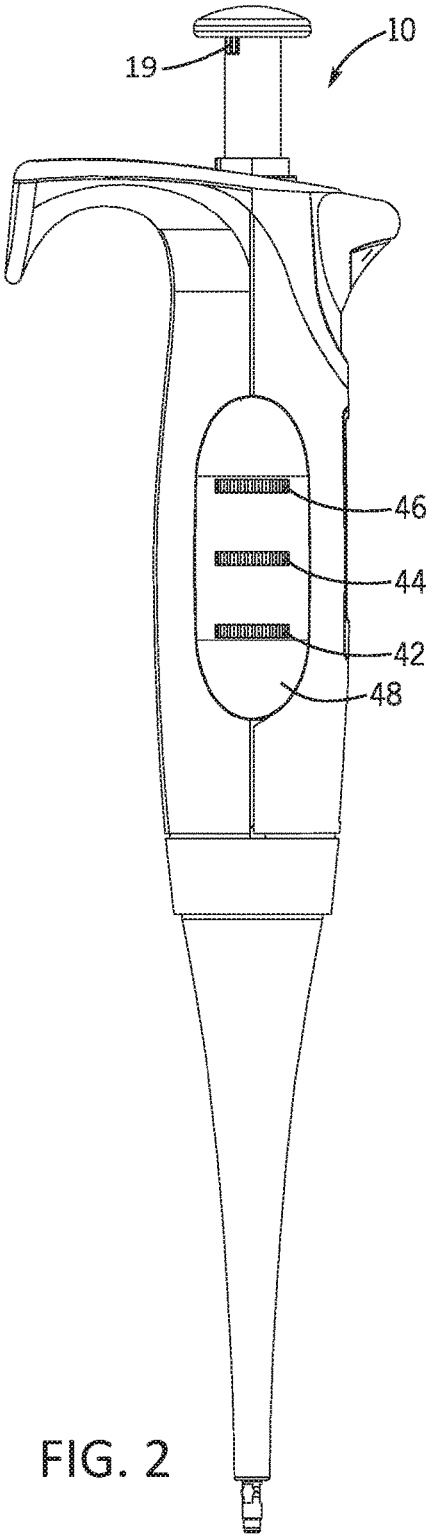
FIG. 2 is a side elevation view of the manual pipette shown in FIG. 1.
Figure 3:
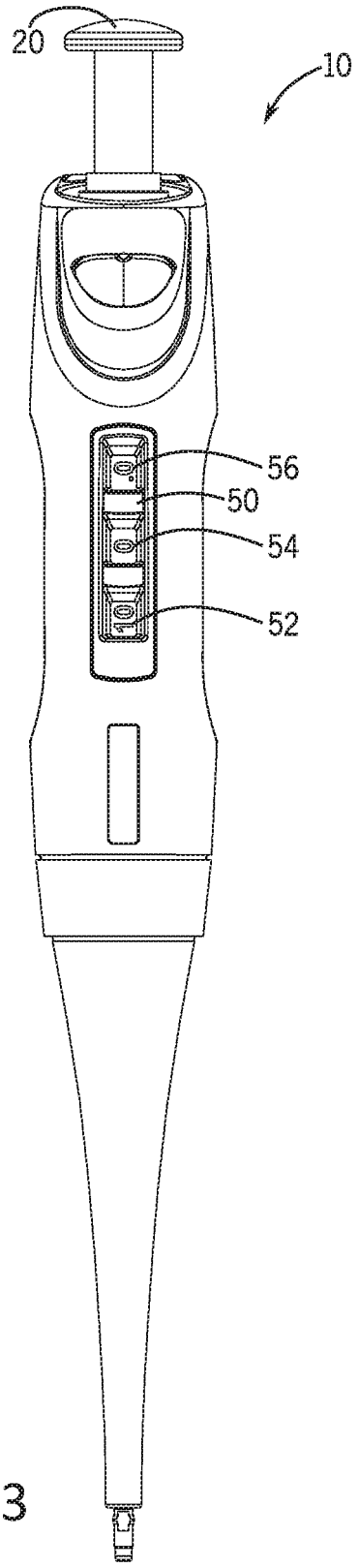
FIG. 3 is a front elevation view of the pipette shown in FIG. 1.
Figure 4:
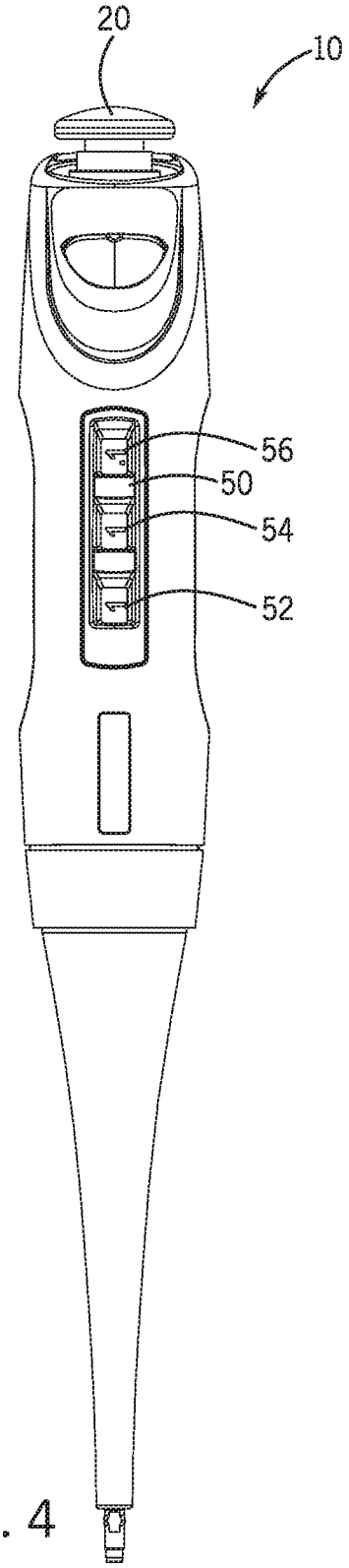
FIG. 4 is another front elevation view of the pipette shown in FIG. 1, showing the plunger button being depressed.

Referring now in particular to FIGS. 1 through 4, the volume adjustment mechanism 30 includes three dials 42, 44 and 46. To adjust the volume of the pipette, the user depresses plunger button 20, and manually turns dials 42, 44 and 46 as necessary to change the volume setting. As discussed in more detail in the figures that follow, the dials 42, 44 and 46 rotate step cylinders to adjust the maximum stroke length for the piston holder 22 and the piston 36. In the embodiment shown in the figures, dial 42 corresponds to a step cylinder with large steps and is used for coarse volume adjustment. Dial 46, on the other hand, turns a step cylinder with small steps and is used for fine volume adjustment. Dial 44 rotates a step cylinder with intermediate size steps and corresponds to intermediate volume adjustment. As shown in FIG. 1, the dials 42, 44 and 46 extend through openings in a dial panel 48 to allow the user manual access to turn the dials. FIG. 2 shows a side of the pipette 10 not shown in FIG. 1. The dials 42, 44 and 46 extend through openings in the dial panel 48 on this side of the pipette 10 as well. Exposure of the dials 42, 44 and 46 for manual access on both sides of the pipette allows the dials to be easily rotated and repositioned with the user's finger and opposing thumb. A numerical scale 52, 54 and 56 is associated with each respective dial 42, 44 and 46. Scale window 50 allows the user to view the settings 52, 54 and 56 for respective dials 42, 44 and 46. FIG. 3 shows the pipette 10 set at 100 μl (i.e., 100.0 μl). FIG. 4 shows the plunger button 20 depressed which is necessary to allow the dials 42, 44 and 46 to be manipulated in order to adjust the volume of the pipette 10. In FIG. 4, the volume of the pipette 10 is set at 11.1 μl.

Figure 5:
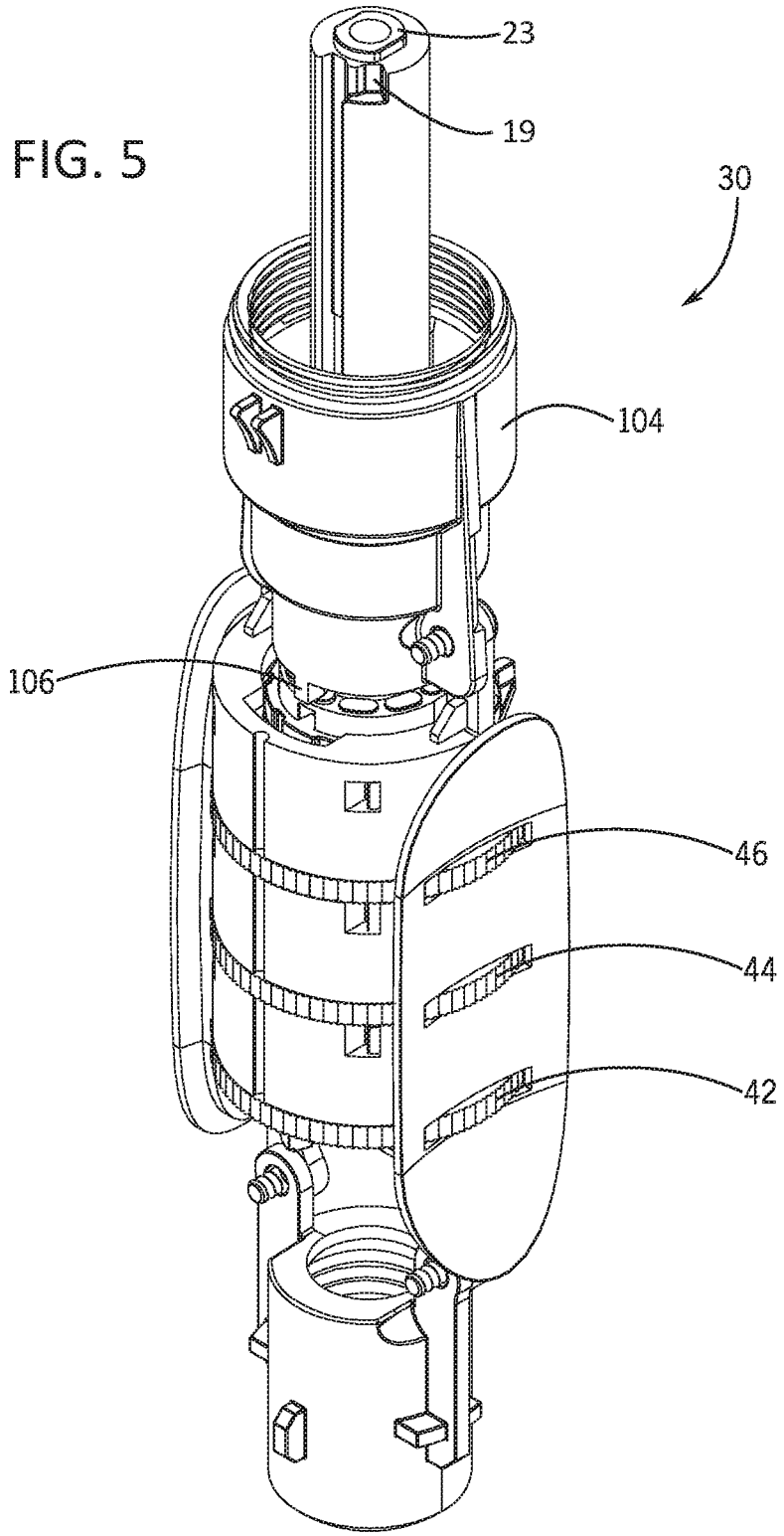
FIG. 5 is a detailed view of internal components of the manual pipette shown in FIG. 1, illustrating various aspects of an exemplary volume adjustment mechanism.
Figure 6:
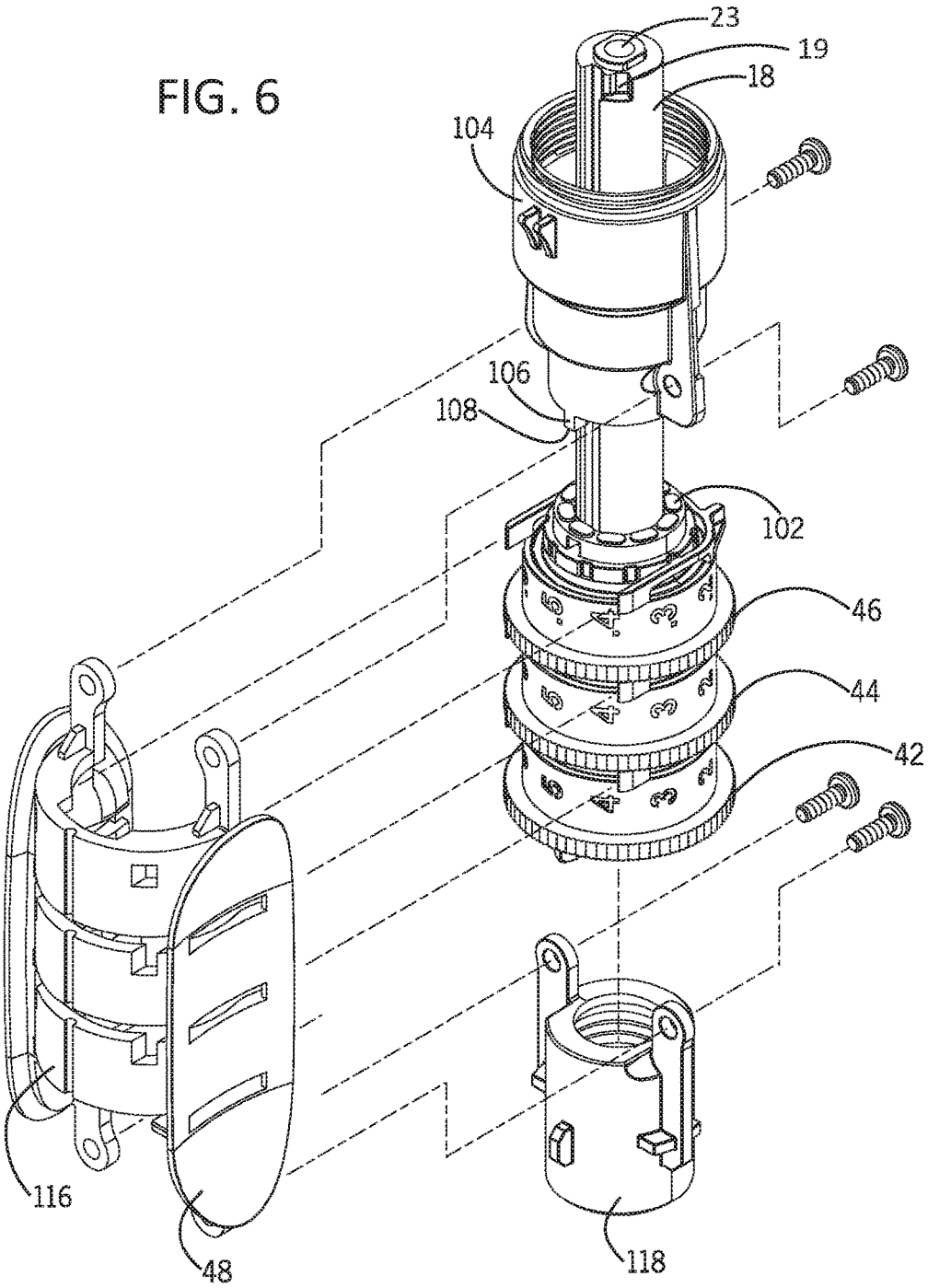
FIG. 6 is a view similar to FIG. 5 with a support chassis exploded away from the remainder of the assembly.
Figure 7:
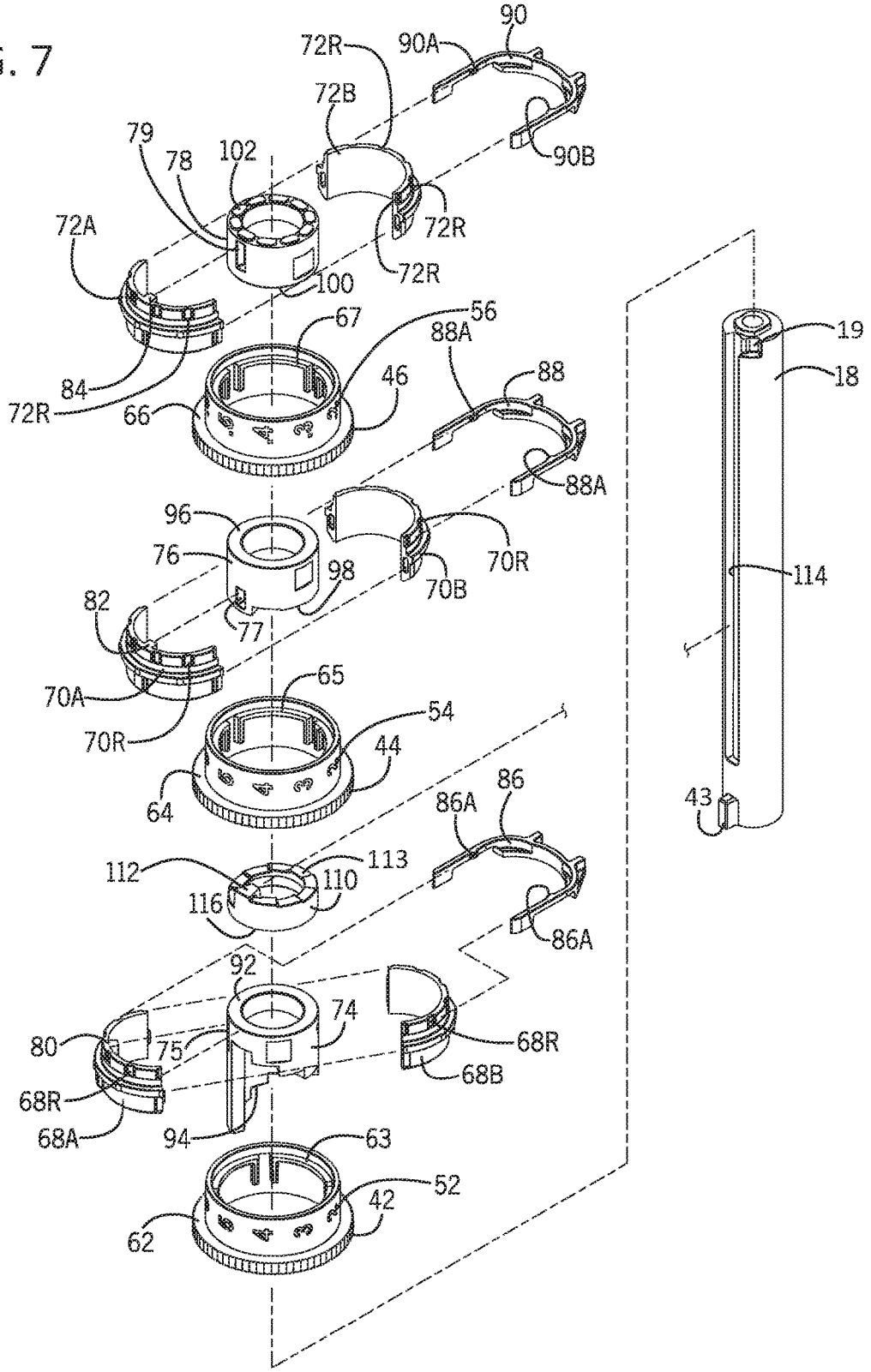
FIG. 7 is an exploded view of components of the volume adjustment mechanism shown in FIG. 5.

The primary components of the volume adjustment mechanism 30 are shown in FIGS. 5 through 7. Referring first to FIG. 7, dial 42 and numerical scale 52 are part of an integral dial body 62. Similarly, dial 44 and numerical scale 54 are part of an integral body 64, and dial 46 and numerical scale 56 is part of a third dial body 66. Each of the dial bodies 62, 64 and 66 includes a generally cylindrical inside surface having specialized support rims 63, 65 and 67 respectively. These support rims 63, 65 and 67 are designed to engage coupling members 68A and B, 70A and B and 72A and B. The coupling members 68A, 68B and 70A, 70B and 72A, 72B are mounted around step cylinders 74, 76 and 78 respectively. The outside surface of the step cylinders 74, 76 and 78 each has a respective slot 75, 77 and 79 which receives an inwardly extending boss 80, 82 and 84 extending inward from one side of the respective coupling members 68A, 70A, and 72A. The inwardly extending bosses 80, 82 and 84 engage the respective slot 75, 77 and 79 on the cylinder 74, 76 and 78 in order to rotate the respective step cylinder when the associated dial 42, 44, 46 is rotated, while at the same time allow for the boss 80, 82 and 84 to move longitudinally or vertically within the slot 75, 77 or 79 on the outside surface of the respective step cylinder 74, 76, 78. Clips 86, 88 and 90 include inward projections 86A, 88A, and 90A that interact with small recesses 68R, 70R, and 72R within each coupling member 68A/68B, 70A/70B, and 72A/72B to provide feedback to the user as to when a setting is properly aligned. The recess interface requires some amount of force to overcome thus providing a stabilizing effect for the setting and preventing accidental movement.

Step cylinder 74 includes a flat surface 92 on its top side and a stepped surface 94 on its bottom side. Similarly, intermediate step cylinder 76 includes a flat surface 96 on its top side and a stepped surface 98 on its bottom side. The fine adjustment cylinder 78, on the other hand, has a flat wall 100 on its bottom side and a stepped surface 102 on its top side. Referring to FIGS. 5 and 6, an upper stationary sleeve 104 is mounted to the pipette and has a downwardly extending boss 106 with a downwardly facing step contact surface 108. Dial 46 is turned in order to align a selected upwardly facing step 102 on the fine resolution step cylinder 78 into alignment with the contact surface 108 on the downwardly extending boss 106 on the upper stationary sleeve 104.

Dial 42 is turned in order to align the appropriate step 94 on the coarse step cylinder 74 into alignment with the vertical position of the plunger positioning boss 43 on the plunger shaft 18. The location of the bottom surface of the respective step 94 that is in vertical alignment with the plunger positioning boss 43 defines the overall stroke of the plunger shaft 18 and the piston holder 22. The coarse step cylinder 74, in accordance with the invention, moves vertically depending on the rotational position of the other step cylinders 76 and 78. In other words, the adjustment of step cylinders 76 and 78 will adjust the relative vertical location of the top surface 92 of the coarse step cylinder 74.

Similar to the coarse and fine step cylinders, turning dial 44 will rotate the intermediate step cylinder 76. The upper flat surface 96 on the intermediate step cylinder 76 engages the lower flat surface 100 on the fine resolution step cylinder 78. Therefore, depending on the rotational position of the fine step cylinder 78, the relative vertical location of the top surface 96 of the intermediate step cylinder 76 will vary. The cooperation between the bottom stepped surface 98 of the intermediate cylinder 76 and the top flat surface 92 of the coarse step cylinder 74 requires the use of a vertically repositionable, non-rotatable cylinder 110. The non-rotatable cylinder 110 has a bottom surface 116 that is flat to interface with the flat upper surface 92 on the coarse step cylinder 74. The non-rotatable cylinder 110 also includes an intermediate platform 112 that faces upwards. Desirably, the platform 112 is keyed to longitudinal slot 114 in the plunger shaft 18 to prevent the non-rotatable cylinder 110 from rotating (although other means can be used to prevent its rotation). The non-rotatable cylinder 110 is capable to move vertically but provides the intermediate platform 112 at a fixed angular orientation to interface with the selected step 98 on the bottom side of the intermediate step cylinder 76. The top surface 113 of the non-rotatable cylinder 110 is shown to be stepped in FIG. 7 as is preferred; however, the steps other than the intermediate platform 112 are not necessary to carry out the invention. The purpose of the steps 113 is to provide adequate clearance at all rotational positions for the intermediate step cylinder 76. The step configuration is used to provide more mass and strength to the non-rotatable cylinder 110.

FIG. 6 illustrates a chassis 116 that is mounted around the volume adjustment mechanism. FIG. 6 also shows the mount 118 for the lower portion of the pipette.

Figures 8, 9, 10:
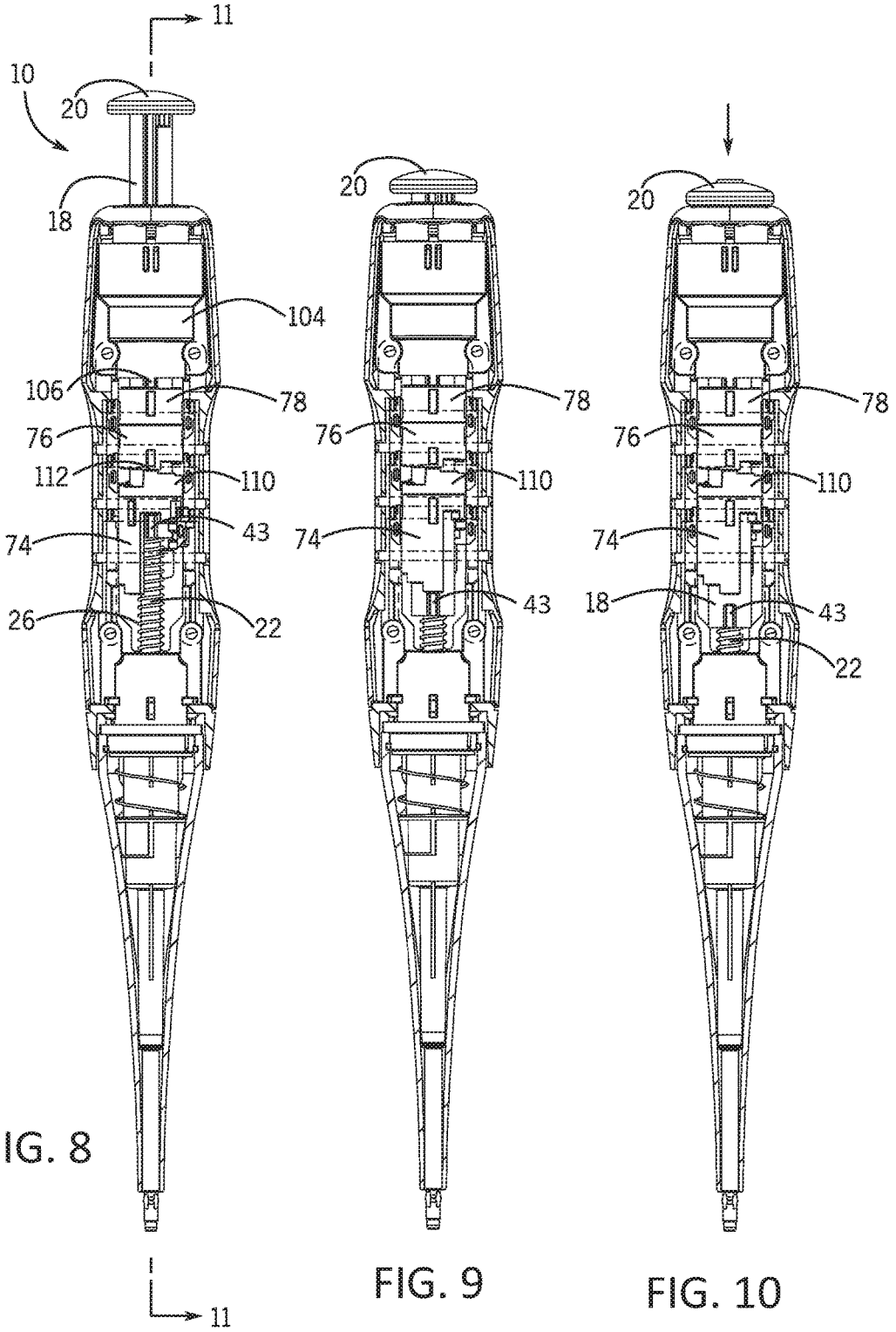
FIG. 8 is a view similar to FIG. 3 with the front housing removed in order to show internal components.
FIGS. 9 and 10 are similar to FIG. 8 illustrating the position of various internal components of the pipette with the plunger button being depressed to various levels.

Referring to FIG. 8, the pipette 10 is shown with the plunger shaft 18 fully extended upward and the plunger positioning boss 43 being pushed upward against one of the steps on the coarse step cylinder 74 under the bias of spring 26. The non-rotatable cylinder 110 and its intermediate platform 112 are in alignment with the plunger positioning boss 43, and the intermediate step cylinder 76 and fine adjustment step cylinder 74 are rotated into selected positions in order to appropriately locate the vertical position of the non-rotating cylinder 110 and the coarse step cylinder 74. FIG. 9 shows a view similar to FIG. 8 in which the coarse step cylinder 74 has been rotated to reduce piston stroke length (and aspiration volume). In FIG. 8, the stroke length for the coarse step cylinder 74 is set at its maximum and in FIG. 9 the stroke length for the coarse step cylinder 74 is set at its minimum. In FIG. 10, the setting of the step cylinders 74, 76 and 78 is the same as in FIG. 9, except FIG. 10 shows the plunger button 20 being depressed to lower the plunger shaft 18 and piston holder 22 in order to lower the piston in the cylinder in the lower portion of the pipette 10. With the plunger button 20 being depressed into the position shown in FIG. 10, the coarse cylinder 74 and the non-rotatable cylinder 110 are free to move vertically downward towards the positioning boss 43. The dials 42, 44, 46 on the volume adjustment mechanism 30 can be adjusted when the plunger button 20 is depressed into the position shown in FIG. 10. The plunger shaft 18 has a locking notch 19 which is used to lock the plunger shaft 18 in the depressed position shown in FIG. 10 if the plunger button 20 and plunger shaft 18 are rotated a quarter turn to engage a catch on the handle. While the plunger shaft 18 needs to be held in the depressed position in FIG. 10 to adjust the dials 42, 44, 46, it is not necessary to lock the plunger shaft 18 in the depressed position to adjust the dials 42, 44, 46.

Figure 11:
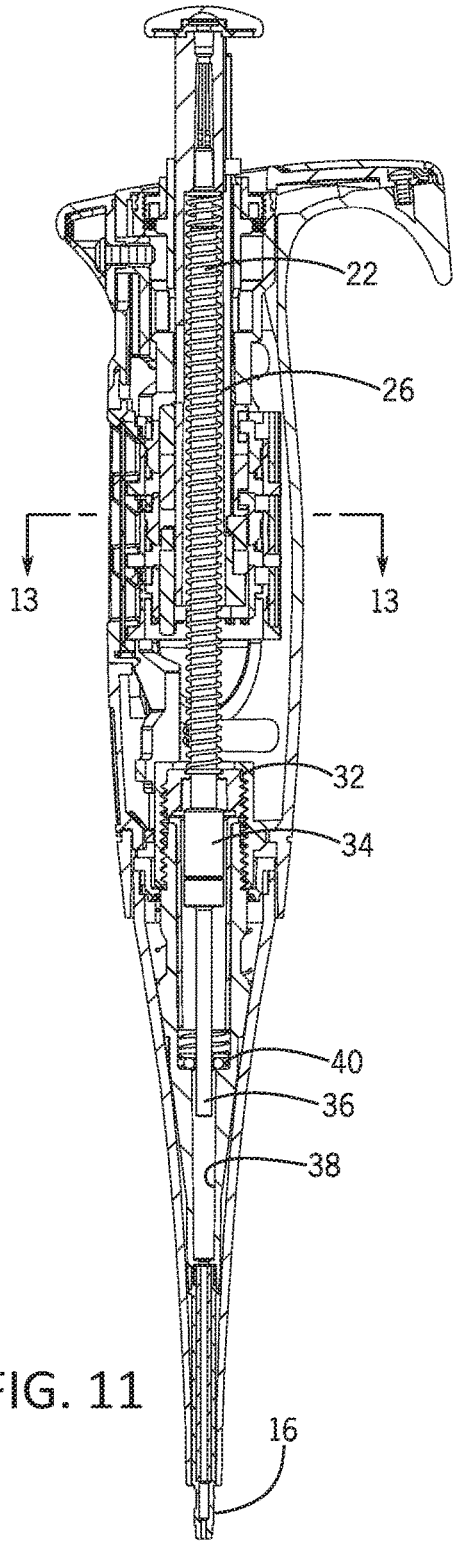
FIG. 11 is a sectional view taken along lines 11-11 in FIG. 8.
Figure 12:
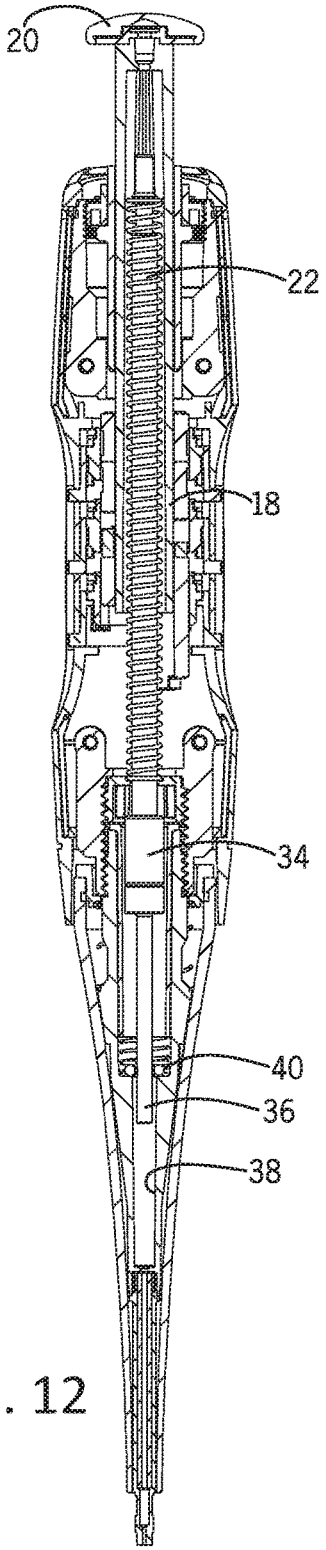
FIG. 12 is another sectional view taken in a plane perpendicular to that shown in FIG. 11.
Figure 13:
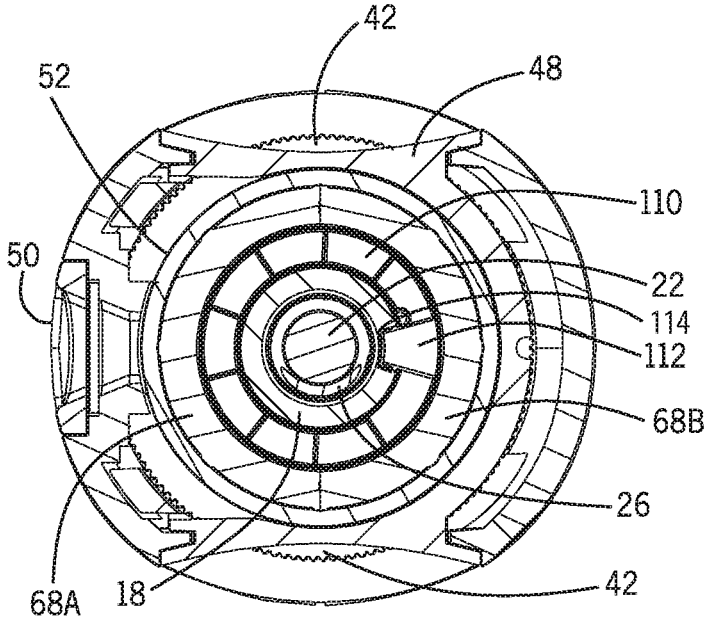
FIG. 13 is a cross-sectional view taken along line 13-13 in FIG. 11.

FIGS. 11 and 12 illustrate a longitudinal sectional view with the pipettor volume setting similar to that shown in FIG. 8 but with other parts broken away in order to show other components. FIG. 13 is a sectional view taken along line 13-13 in FIG. 11 through the upper portion of the pipette 10. The view is taken just about the intermediate platform 112 on the non-rotatable cylinder 110. It shows the platform 112 residing in a notch or longitudinal slot 114 in the plunger shaft 18. It also shows coupling members 68A and 68B for the coarse step cylinder 74 and the dial 42 for the coarse step cylinder. FIG. 13 also shows dials 42 exposed through dial panels 48 and accessible to the user by the finger and opposing thumb on one hand. In addition, FIG. 13 shows window 50 that enables the user to view the setting 52 for the coarse step cylinder.

Figure 14:
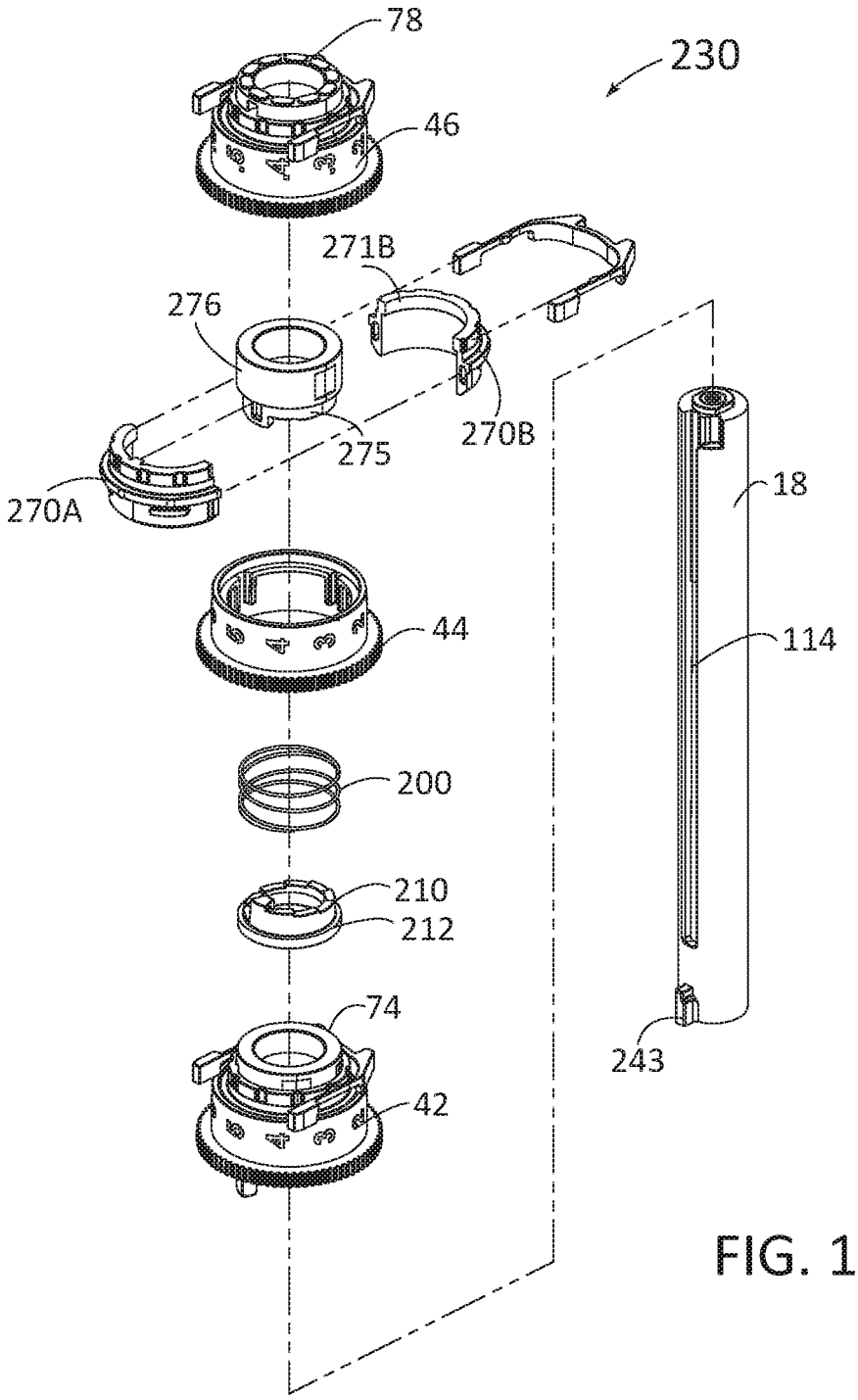
FIG. 14 is an exploded view similar to FIG. 7 showing components of another exemplary volume adjustment mechanism.
Figure 15:
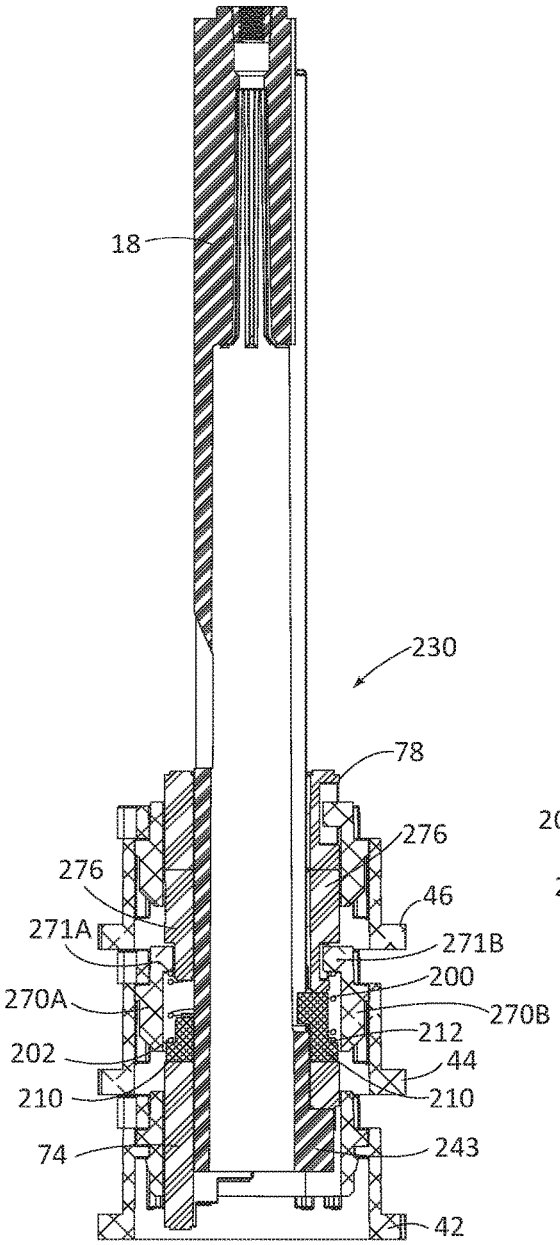
FIG. 15 is cross-sectional view of the assembled volume adjustment mechanism shown in FIG. 14 with the components positioned at a maximum volume setting.
Figure 16:
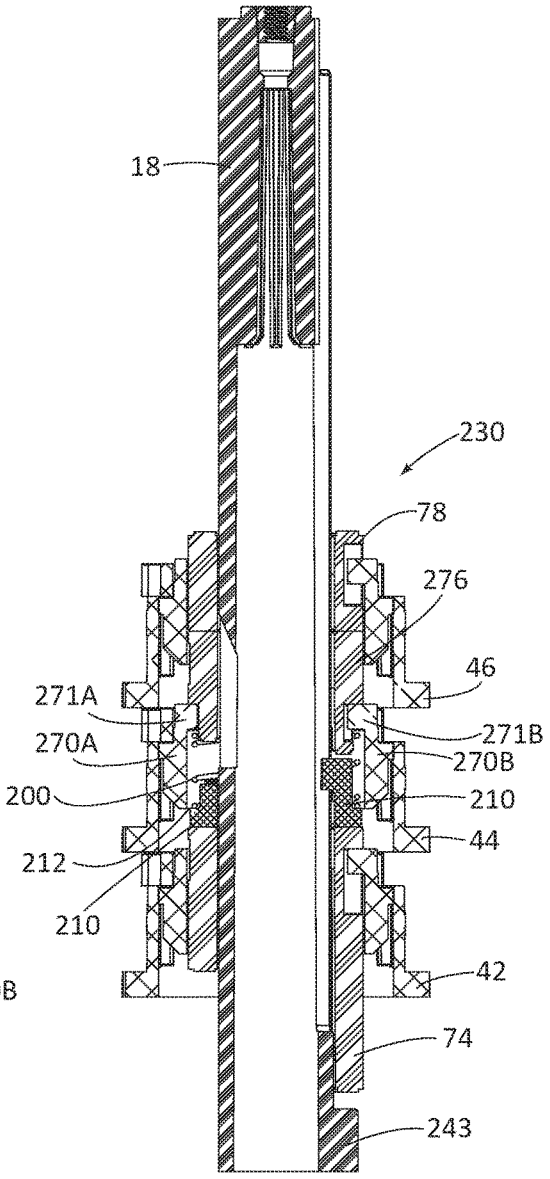
FIG. 16 is another cross-sectional view of the assembled volume adjustment mechanism shown in FIG. 14 with the components positioned at a volume adjustment position.

FIGS. 14 through 16 show another embodiment of the volume adjustment mechanism 230 in which a light weight spring 200 facilitates smooth, consistent release of the components during volume adjustment. FIGS. 14 through 16 use the same reference numbers as in FIGS. 1 through 13 for the components that are the same. Different reference numbers are used for new components or components that are modified.

Referring to FIGS. 14 through 16, the spring 200 is located between the non-rotatable cylinder 210 and the intermediate step cylinder 276. This ensures that the non-rotatable cylinder 210 and the coarse step cylinder 74 are moved to a free position for adjusting when the plunger shaft 18 is depressed to the required position. A free position means that the unloaded components have enough clearance to rotate 360 degrees without interference. In the embodiment shown in FIGS. 5 through 13, gravity is relied on for this function, which may not operate as consistently or smoothly as the embodiment in FIGS. 14 through 16 with the spring 200.

FIG. 16 shows the volume adjustment mechanism 230 in the free position for adjusting the volume setting, and shows the light weight spring 200 biasing the non-rotatable cylinder 210 and the coarse step cylinder 74 downward from the intermediate step cylinder 276 and the coupling members 270A, 270B for the intermediate step cylinder 276. The position of the plunger shaft 18 shown in FIG. 16 is the position of the plunger shaft 18 when it is depressed to dispense liquid from the pipettor as well.

To accommodate the light weight spring 200, each intermediate coupling member 270A, 270B includes a landing rib 271A, 271B. The landing ribs 271A, 271B provide a fixed location for the top end of the light weight spring 200. The intermediate step cylinder 276 has a relief area 275 to accommodate the landing ribs 271A, 271B on the intermediate coupling members 270A, 270B. In addition, a circumferential landing rib 212 is provided on the non-rotatable cylinder 210 for engaging the bottom end of the light weight spring 200. During operation, the spring force of the light weight spring 200 is overcome by the spring force of the primary piston return spring 26, which results in the step cylinders and non-rotatable cylinder interacting and stacking as described in the embodiment shown in FIGS. 5 through 13 to set the piston stroke. However, when the piston return spring 26 is unloaded, the light weight spring 200 biases the non-rotatable cylinder 210 and the coarse cylinder 74 downward.

While the embodiments of the invention shown in the drawings show a single-channel, manual pipette, those skilled in the art will appreciate that the invention can be applied to multi-channel, manual pipettes as well.

We claim:

1. A volume adjustable, manual pipette comprising:

an upper pipette body adapted to be held in the hand of a user;

a plunger shaft assembly mounted of the upper pipette body for reciprocating vertical motion, the plunger shaft assembly comprising:

a plunger shaft having a button that extends upward from the upper pipette body and a plunger positioning boss; and a piston holder connected to and extending downward from the button and moving in unison with the button, the plunger shaft and the plunger positioning boss;

a pipetting piston operatively coupled to a lower end of piston holder so that the pipetting piston moves in unison with the plunger button and piston holder, and a volume adjustment mechanism that stops retraction of the plunger positioning boss to set a full stroke length of the plunger shaft and pipetting piston, said volume adjustment mechanism including a series of three rotatable step cylinders that surround the plunger shaft assembly; wherein each of the three rotatable step cylinders has steps a fixed height; and further wherein the height of the steps on each step cylinder is different from the height of the steps on the other step cylinders, and the step cylinders can be manually rotated independently to set the position of the steps and the full stroke length of the plunger shaft.

2. The manual pipette recited in claim 1 wherein the three step cylinders comprise an upper cylinder, an intermediate cylinder and a lower cylinder, and each step cylinder includes a top and a bottom with multiple steps located circumferentially around one of the top or the bottom of respective cylinder and the other of the top and the bottom is flat, and the manual pipette further comprises a vertically repositionable, non-rotatable cylinder having a top and a bottom with an intermediate platform on one of the top or the bottom and a flat surface on the other of the top or bottom, said non-rotatable cylinder being located between two of the step cylinders such that a selected step on the intermediate step cylinder engages the intermediate platform on the vertically repositionable, non-rotatable cylinder.

3. The manual pipette recited in claim 2 wherein the upper step cylinder comprises steps located circumferentially around its top and its bottom is flat; the intermediate step cylinder comprises steps located circumferentially around its bottom and its top is flat; the lower step cylinder comprises steps located circumferentially around its bottom and its top is flat; and the non-rotatable cylinder comprises the intermediate platform on its top and its bottom is flat.

4. The manual pipette recited in claim 2 further comprising an upper stationary sleeve mounted to the upper pipette body, said upper stationary sleeve comprising a downwardly extended boss providing a step contact surface such that a selected step on the upper step cylinder engages the step contact surface on the upper stationary sleeve.

5. The manual pipette recited in claim 2 wherein the height of the steps on the upper cylinder is less than the height of the steps on the intermediate cylinder and the height of the steps on the intermediate cylinder is less than the height of the steps on the lower cylinder.

6. The manual pipette as recited in claim 5 wherein one of the step cylinders comprises at least two steps and the other two step cylinders comprise at least ten steps.

7. The manual pipette as recited in claim 6 wherein each step cylinder comprises ten steps.

8. The manual pipette recited in claim 2 further comprising a piston return spring that loads all cylinders together and a light spring that biases the non-rotatable cylinder and the coarse step cylinder away from the intermediate step cylinder when the plunger shaft is depressed to overcome the load of the piston return spring on the cylinders.

9. The manual pipette recited in claim 2 wherein the vertically repositionable, non-rotatable cylinder is keyed to the plunger shaft so that the vertically repositionable, non-rotatable cylinder does not rotate when one or more of the step cylinders are rotated to adjust the piston stroke.

10. The manual pipette as recited in claim 1 further comprising three dials, each dial having a dial body coupled to a respective step cylinder; and at least one opening through a housing for the upper pipette body to provide user access to an outside surface of each dial so that the user can rotate each dial and the respective step cylinder to adjust the vertical position of the step in the lower most of the three step cylinders in alignment with the plunger positioning boss and set the full stroke length of the plunger shaft and pipetting piston.

11. The manual pipette recited in claim 10 further comprising at least one more opening through the housing and located on the other side of the housing to provide user access to another surface of each dial so that the user can rotate each respective dial and step cylinder using an opposed thumb and finger.

12. The manual pipettor as recited in claim 10 further comprising intermediate couplings between the respective dial bodies and step cylinders, wherein the dials remain vertically stationary with respect to the pipette, each intermediate coupling is keyed to the respective dial body to rotate with the dial but slide longitudinally with respect to one another, and each step cylinder includes a longitudinal slot that receives a boss extending inward from the respective intermediate coupling such that turning the respective dial cause the boss to rotate the respective step cylinder and the boss is able to slide longitudinally within the slot.

13. A manual pipettor as recited in claim 10 wherein each dial includes a scale corresponding to the rotary positions of the steps on the respective step cylinder, and said scale is viewable through a window in the pipette housing.

14. A manual pipettor as recited in claim 10 further comprising a chassis that holds the step cylinders and dials, and is fixed to the pipettor housing.

15. A manual pipettor as recited in claim 1 wherein the manual pipettor is a multi-channel pipettor comprising in the lower portion a main piston drive shaft, a piston drive bar and multiple pipetting pistons.

* * * * *